US005539835A

United States Patent [19]

Bertagni et al.

[11] Patent Number: 5,539,835

[45] Date of Patent: Jul. 23, 1996

[54] PLANAR-TYPE LOUDSPEAKER WITH DUAL DENSITY DIAPHRAGM

[75] Inventors: Alejandro J. Bertagni, Lake Forest; Eduardo J. Bertagni, Tustin; Alfredo D. Ferrin, Irvine, all of Calif.

[73] Assignee: Sound Advance Systems, Inc., Santa Ana, Calif.

[21] Appl. No.: 363,713

[22] Filed: Dec. 23, 1994

Related U.S. Application Data

[63] Continuation of Ser. No. 866,067, Apr. 9, 1992, Pat. No. 5,425,107.

[51] Int. Cl.[6] ..... H04R 25/00

[52] U.S. Cl. ..... 381/202; 381/188; 381/205

[58] Field of Search ..... 381/202, 203, 381/204, 192, 182, 186, 205, 188; 181/163, 164, 170, 173, 174, 199

[56] References Cited

U.S. PATENT DOCUMENTS

| | | |
|---|---|---|
| 3,046,362 | 7/1962 | White . |
| 3,596,733 | 8/1971 | Bertagni . |
| 3,722,617 | 3/1973 | Bertagni . |
| 3,767,005 | 10/1973 | Bertagni . |
| 3,779,336 | 12/1973 | Bertagni . |
| 3,792,394 | 2/1974 | Bertagni . |
| 3,801,943 | 4/1974 | Bertagni . |
| 4,003,449 | 1/1977 | Bertagni . |
| 4,184,563 | 1/1980 | Bertagni . |
| 4,257,325 | 3/1981 | Bertagni . |
| 4,928,312 | 5/1990 | Hill . |
| 4,997,058 | 3/1991 | Bertagni . |
| 5,007,707 | 4/1991 | Bertagni . |

*Primary Examiner*—Curtis Kuntz
*Assistant Examiner*—Huyen D. Le
*Attorney, Agent, or Firm*—Pretty, Schroeder, Brueggemann & Clark

[57] ABSTRACT

A planar-type loudspeaker incorporating a substantially planar diaphragm constructed from a pre-expanded cellular plastic material, such as polystyrene, in which separate portions of the diaphragm have different densities. The higher density portion is designed for the reproduction of high frequencies, and the lower density section is used for the reproduction of low frequencies. In one embodiment, the diaphragm is formed by laminating together a pair of diaphragm members having the different densities to define a single sound producing region, to which a single voice coil assembly is coupled. In another embodiment, the diaphragm is formed as a unitary, one-piece structure having separate but contiguous sound producing regions, each with its own density material and voice coil assembly for reproducing a specified frequency range of sound.

10 Claims, 2 Drawing Sheets

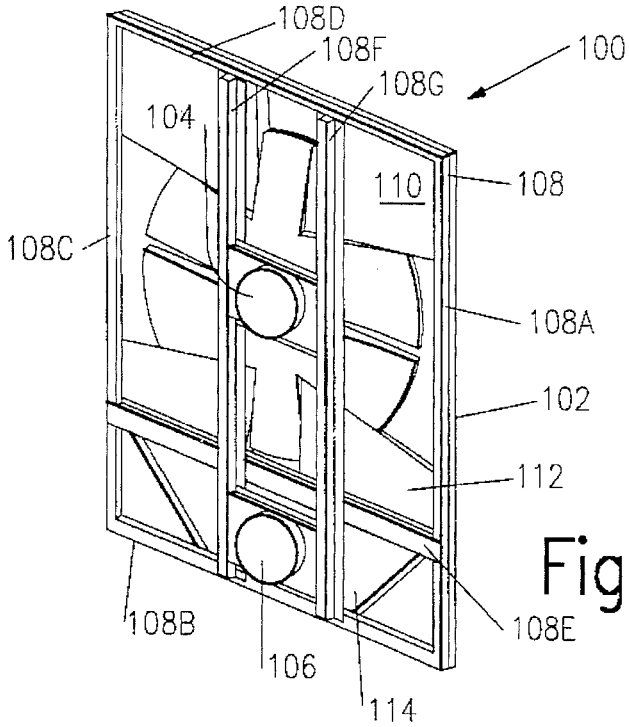
Fig.5
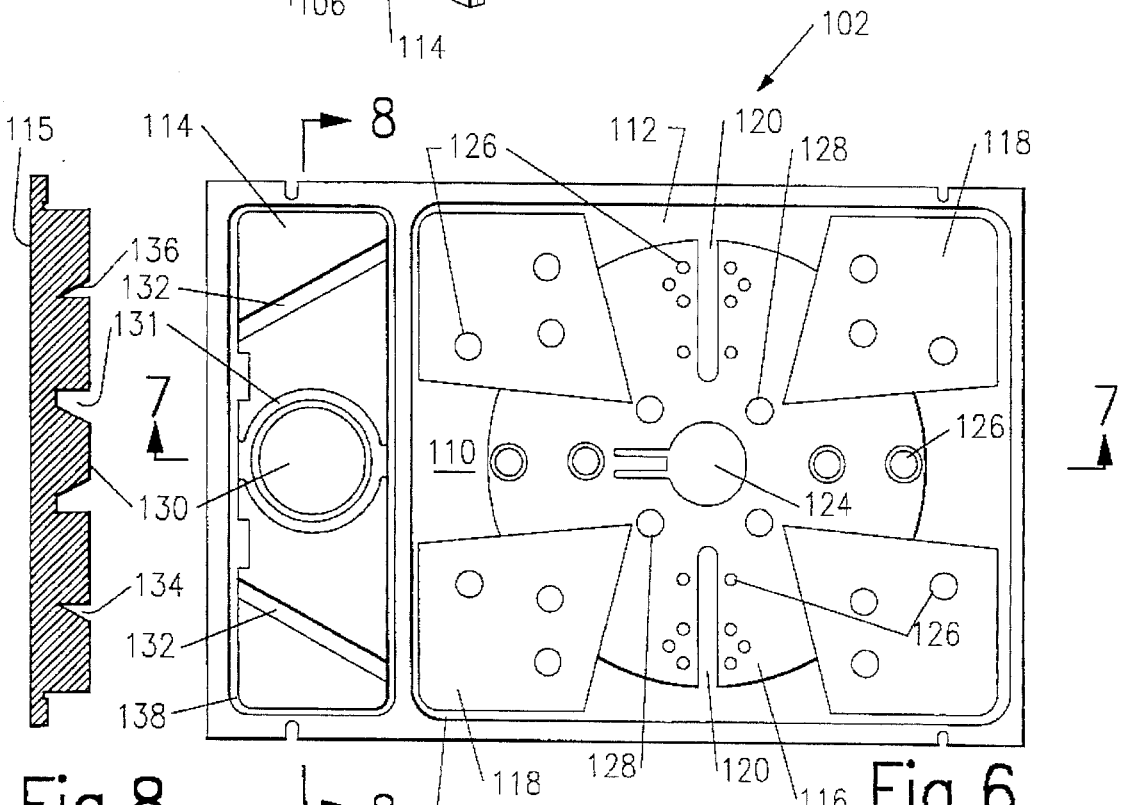
Fig.8
Fig.6
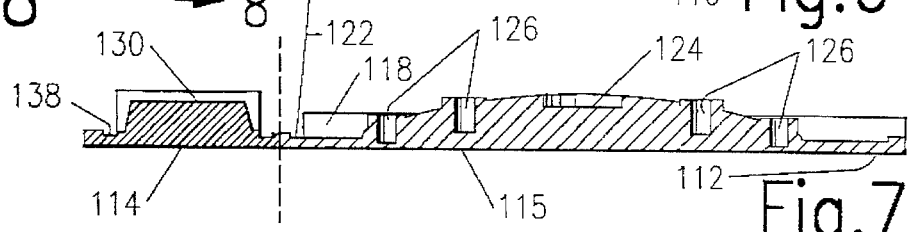
Fig.7

PLANAR-TYPE LOUDSPEAKER WITH DUAL DENSITY DIAPHRAGM

This application is a continuation of application Ser. No. 07/866,067, filed Apr. 9, 1992, now U.S. Pat. No. 5,425,107.

BACKGROUND OF THE INVENTION

This invention relates generally to loudspeakers and, more particularly, to planar-type loudspeakers having a substantially flat diaphragm.

Dynamic-type loudspeakers typically include a relatively stiff diaphragm that is coupled to an electromagnetic driver assembly, which basically comprises a voice coil and a permanent magnet. Such loudspeakers are usually mounted so as to occupy an opening in an enclosure or baffle. The interaction of the magnetic field of the permanent magnet and the magnetic field of the voice coil that is produced when a changing current is passed through the voice coil causes the loudspeaker diaphragm to vibrate. Vibration of the diaphragm causes movement of air, which in turn produces sound.

The loudness of the sound produced by a loudspeaker is related to the volume of air moved in front of the loudspeaker by vibration of the diaphragm. Generally, the greater the volume of air moved by the diaphragm as it vibrates, the greater the loudness. The efficiency of the loudspeaker can be measured by the loudness of sound produced relative to the electrical energy provided as an electric current through the voice coil.

For maximum efficiency and sound fidelity, it is known to provide loudspeaker systems with multiple diaphragm/voice coil assemblies. Each diaphragm/voice coil assembly is typically sized and constructed for optimal performance over a specific frequency range. For example, one diaphragm/voice coil assembly may be designed to reproduce low frequencies from about 100 to 500 Hz., while another diaphragm/voice coil assembly might be designed to reproduce high frequencies from about 500 to 20,000 Hz. The combination of all the specific-frequency diaphragm/voice coil assemblies, or drivers, generally produces a more accurate, less distorted sound when compared with systems having a single diaphragm/voice coil assembly to reproduce all of the sound frequencies.

For decades, conventional loudspeaker diaphragms have had a cone-type construction made from pressed paper or the like. In more recent years, certain advances in dynamic loudspeaker design have been provided by the advent of planar diaphragm loudspeakers. Such loudspeakers include a relatively stiff and substantially planar (or flat) diaphragm that is mounted in a frame and that is coupled at its rear surface to the speaker voice coil, such that the voice coil acts like a piston, pressing on the rear surface of the diaphragm and causing sufficient vibration of the diaphragm to efficiently produce sound. Examples of such planar diaphragms are shown and described in U.S. Pat. Nos. 4,003,449 and 4,997,058, both issued in the name of Jose J. Bertagni.

Typically, a planar diaphragm is constructed of a pre-expanded cellular plastic material, such as polystyrene or styrofoam. The frequency response of a planar diaphragm generally is determined by the type and density of its material, and the area, thickness and contour of its sound producing region. Typically, in the design of such a diaphragm, the designer chooses a suitable type and density of material, and then experiments with different sizes and configurations for the diaphragm to achieve an acceptable degree of fidelity in the reproduction of sound in both the low and high frequency ranges.

Some of the advantages provided by planar diaphragm loudspeakers over loudspeakers utilizing conventional cone-type diaphragms include greater dispersion of sound and economy of manufacture. A further advantage is that the front surface of the diaphragm can be molded to take on the appearance of a relatively large acoustic tile, permitting unobtrusive installation of the loudspeaker in ceilings of commercial structures formed of like-appearing acoustic tiles. Alternatively, the diaphragm's front surface can be molded smooth and flat, and a number of such diaphragms can be joined together in a contiguous and seamless array to create a sound screen upon which video images can be projected, as shown and described in U.S. Pat. No. 5,007,707, also issued in the name of Jose J. Bertagni.

One way in which high fidelity sound reproduction has been realized over a wide range of frequencies with unitary, one-piece planar diaphragms has been to form channels in the rear surface of the diaphragm to define different frequency sections having prescribed areas, thicknesses and contours. Each section of the diaphragm is coupled to a different voice coil such that each section and voice coil combination can be used for reproducing a specific range of sound frequencies relatively independently of the other sections of the diaphragm. A rigid frame member in contact with the diaphragm along the boundary between adjacent sound producing regions can be used to isolate them from one another.

Although existing planar diaphragm loudspeakers have been generally satisfactory, there has been need for improvement. One disadvantage of unitary diaphragms is that the density of material selected for them has represented a compromise between the low frequency and the high frequency ranges. Planar diaphragms tend to respond more efficiently to high frequencies when the diaphragms are formed of higher density material; conversely, planar diaphragms tend to respond more efficiently to low frequencies when formed of lower density material. The solution was the choice of an intermediate density material that was deemed adequate, but not optimal for both low and high frequency ranges.

Moreover, it would be a great advantage to install planar diaphragm loudspeakers within building walls of residential structures. The nature of the diaphragm material would then allow it to become a seamless part of the wall surface, so that the loudspeaker could be completely hidden in the wall or ceiling and made totally unobtrusive. Existing techniques, however, have been unable to provide planar diaphragm loudspeakers with satisfactory frequency responses in designs that are small enough to fit within the normal spacing between wall studs or ceiling rafters in conventional residential construction.

Thus, it will be appreciated that there exists a need for improvement in planar diaphragm loudspeakers that will enable better frequency response and efficient reproduction of sound, as well as more compact designs requiring less space for installation and operation. The present invention fulfills these needs.

SUMMARY OF THE INVENTION

Briefly, and in general terms, the present invention resides in a planar diaphragm loudspeaker in which at least two different densities of material are utilized in different portions of the diaphragm. In accordance with the invention, these different densities can be achieved by joining together two or more diaphragm members that have been individually molded with different density materials, or the molding process itself can be controlled so that the different densities are directly molded into a unitary, one-piece diaphragm.

The different density portions of the resulting diaphragm can define one sound producing region for coupling to a single electromagnetic driver to reproduce both low and high frequencies, or the diaphragm can have multiple sound producing regions, each with its own driver and different density material for reproducing a specified range of frequencies. In this way, the densities of the diaphragm can be more nearly optimized for higher fidelity in the reproduction of both low frequencies and high frequencies. Furthermore, the ability to use lower density material for the reproduction of low frequency sound, in particular, enables the diaphragm to have a smaller overall area for a more compact loudspeaker design suitable for installation in walls and other restricted locations.

More specifically, and by way of example only, a planar diaphragm in accordance with the present invention can be constructed by laminating together two diaphragm members having different areas and densities. The two diaphragm members can have a circular shape. The diaphragm member with the larger area is formed of a lower density material than the diaphragm with the smaller area. For example, the larger diaphragm member can have a density in the range of about 1.5 to 2.5 lbs/ft$^3$, which is more optimal for reproduction of low frequencies, while the smaller diaphragm can have a density in the range of about 2.5 to 4.0 lbs/ft$^3$, which is more optimal for high frequencies, depending in part on the specific material utilized. The larger diaphragm member has a relatively smooth and flat face surface, and its rear surface has a slightly raised contour, with an indentation or recess that is sized and shaped to receive the smaller diaphragm member. The two diaphragm members are adhered together by suitable means, such as epoxy cement. A loudspeaker utilizing this diaphragm is constructed by suspending the larger diaphragm member along its outer periphery from a support frame, and coupling an electromagnetic driver to the smaller diaphragm member.

The different densities of the diaphragm members are selected so that the large diaphragm member has optimal flexibility to move back and forth in response to low frequency vibration of the voice coil, but loses efficiency at higher frequencies so that sound energy from the voice coil is principally reproduced by the higher density small diaphragm member. Thus, specific frequencies of sound are generated by the structure that will most efficiently reproduce them. Moreover, by utilizing different densities for the diaphragm members, including most importantly an optimally low density for low frequency sound reproduction, a more compact planar loudspeaker design is possible.

Alternatively, and again by way of example only, the diaphragm can be formed as a unitary, one-piece structure in which different densities of material are directly molded into different sound producing regions of the diaphragm, separated by channels formed in the rear face of the diaphragm. The density of the section that will reproduce low frequencies can thus be made less than the density of the section that will reproduce high frequencies, so that the low frequency section has greater flexibility to achieve a satisfactory low frequency response with reduced diaphragm area. By control of the molding process, the same density differential can be achieved in the unitary diaphragm as with the two-piece diaphragm previously described, that is, for example, the high frequency section of the diaphragm can have a density in the range of about 2.5 to 4.0 lbs/ft$^3$, whereas the low frequency section of the diaphragm can have a density in the range of about 1.5 to 2.5 lbs/ft$^3$, again depending in part on the material utilized.

In a presently preferred embodiment of the invention utilizing this approach, the diaphragm has an overall rectangular shape, with a smooth and flat face surface. The rear surface of the diaphragm is divided into a relatively large, rectangularly-shaped low frequency region, and a smaller, rectangularly-shaped high frequency section. The low frequency section is characterized by a raised symmetric cross pattern, with a flat indentation in the center to which the low frequency driver can be coupled, and raised blocks located between the arms of the cross. Grooves are formed in at least two opposing arms of the cross for greater linear flexibility. The high frequency section similarly is characterized on the rear face of the diaphragm by a flat land for coupling the high frequency driver and has channels straddling the land.

A loudspeaker utilizing this diaphragm can be made sufficiently compact to be installed between studs or joists in ordinary residential walls or ceilings, with the face surface of the diaphragm flush with the plasterboard or other wall covering. The seams between the diaphragm and wall covering material can then be filled and covered so that the diaphragm becomes a seamless part of the wall or ceiling, and the entire diaphragm can then concealed by paint or even a layer of wallpaper without significant degradation of the sound reproducing qualities of the loudspeaker.

Thus, it will be appreciated that these planar diaphragms, and loudspeakers incorporating them, can be made in relatively compact designs that are simple and economical to manufacture, yet provide improved frequency response over substantially the entire range of low and high sound frequencies. Other features and advantages of the present invention should be apparent from the following description of the preferred embodiment, taken in conjunction with the accompanying drawings, which illustrate, by further way of example, the principles of the invention.

BRIEF DESCRIPTION OF THE DRAWINGS

FIG. 5 is a perspective view of an alternative embodiment of a dual voice coil, planar diaphragm loudspeaker of the present invention utilizing a one-piece, dual density diaphragm, and showing the rear surfaces of the low frequency and high frequency reproduction sections of the diaphragm;

FIG. 6 is a plan view of the rear surface of the one-piece diaphragm illustrated in FIG. 5, separated from the frame structure and voice coils of the loudspeaker;

FIG. 7 is a cross-sectional view taken along the line 7—7 through the one-piece diaphragm illustrated in FIG. 6; and FIG. 8 is a cross-sectional view taken along the line 8—8 through the high frequency section of the unitary diaphragm illustrated in FIG. 6.

DESCRIPTION OF THE PREFERRED EMBODIMENTS

Figure 1:
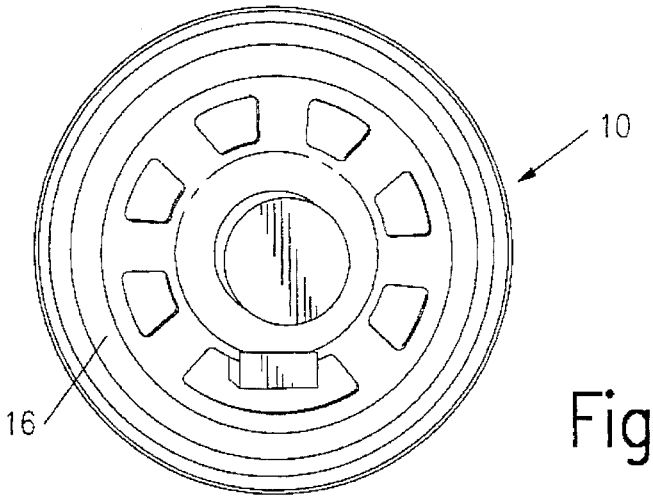
FIG. 1 is a perspective view of one embodiment of a planar diaphragm loudspeaker in accordance with the present invention utilizing a two-piece, dual density diaphragm.
Figure 3:
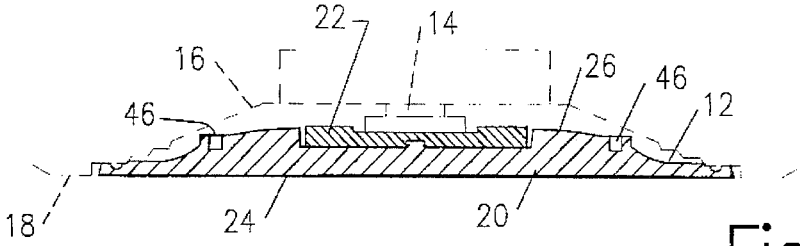
FIG. 3 is a cross-sectional view taken along the line 3—3 through the two-piece diaphragm illustrated in FIG. 2, with the supporting frame structure and electromagnetic driver of the loudspeaker indicated by phantom lines.

Referring now to the drawings, and particularly to FIGS. 1 and 3 thereof, there is shown a planar diaphragm loudspeaker, indicated generally by reference numeral 10, including a two-piece, dual density diaphragm 12 and a voice coil assembly 14 coupled to the diaphragm within a supporting frame structure 16. In the configuration illustrated, the loudspeaker 10 is designed to be received within an opening in a ceiling or wall (not shown), and the supporting frame structure 16 includes a rim 18 (FIG. 3) for surface mounting the front of the loudspeaker. The supporting frame structure 16, including the mounting rim 18, and the voice coil assembly 14 are conventional and thus are indicated only by phantom lines in FIG. 3.

Figure 4:
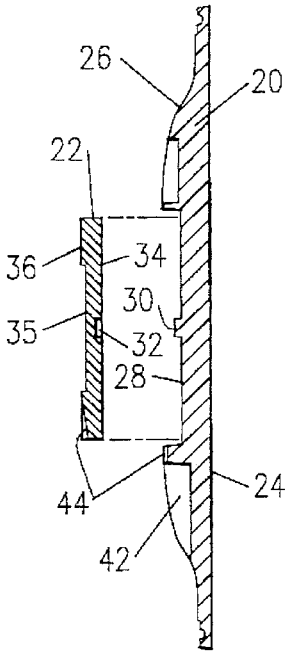
FIG. 4 is a cross-sectional view taken along the line 4—4 through the two-piece diaphragm illustrated in FIG. 2, showing the two diaphragm members separated.
Figure 2:
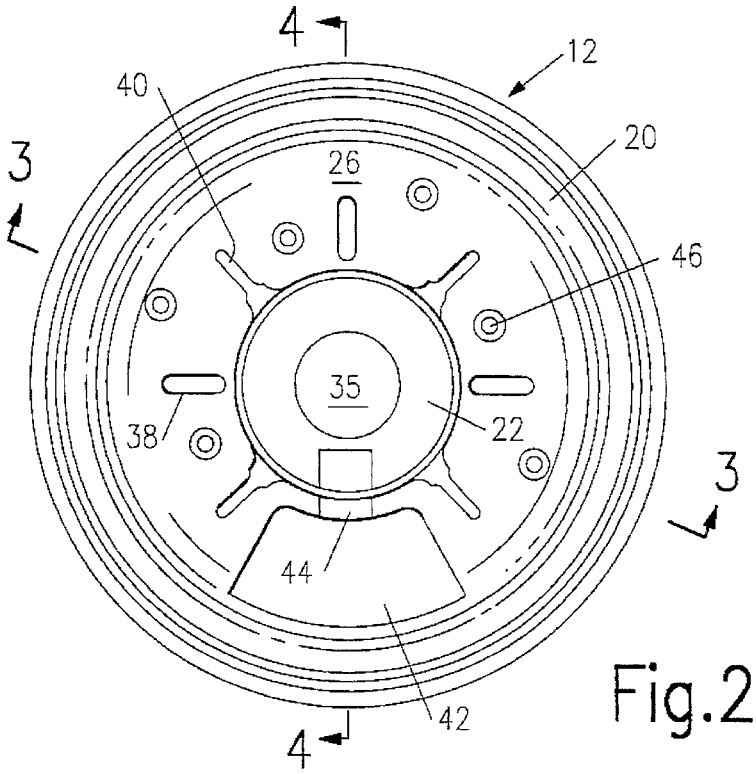
FIG. 2 is a plan view of the rear surface of the two-piece diaphragm shown removed from the loudspeaker illustrated in FIG. 1.

As shown in FIGS. 2–4, the planar diaphragm 12 comprises first and second diaphragm members 20 and 22, respectively, both of which are generally flat and have a circular shape. The first diaphragm member 20 has a substantially larger diameter than the second diaphragm member 22, and its face surface 24 is exposed at the front of the loudspeaker 10 for the reproduction of sound. The rear surface 26 of the first diaphragm member 20 has a raised center portion that generally tapers towards its periphery, where it is attached to the mounting rim 18 by any suitable means such as double-sided tape.

In the center of the rear surface 26 of the first diaphragm member 20 there is formed a circular recess 28 (FIG. 4) of sufficient diameter and depth to receive the second diaphragm member 22. At the center of this circular recess 28 there is formed a centering pin 30 which aligns with a centering hole 32 formed in the center of the front surface 34 of the second diaphragm member 22. The second diaphragm member 22 is adhered within the circular recess 28 to the rear surface 26 of the first diaphragm member 20 by epoxy cement. A circular recess 35 is formed in the rear surface 36 of the second diaphragm member 22, in turn, for coupling to the voice coil assembly 14, also by epoxy cement. Other adhesives can be utilized to join the diaphragm members 20 and 22 together, and to couple the voice coil assembly 14 to the second diaphragm member 22, provided that the adhesive contains no solvent to attack the material, forms a reliable bond, and cures to a very hard state.

In accordance with a primary aspect of the present invention, the first diaphragm member 20 and the second diaphragm member 22 are molded from Scott MB500 polystyrene to have different densities. As indicated by the cross-hatching in FIGS. 3 and 4, the first diaphragm member 20 has a lower density than the density of the second diaphragm member 22. Specifically, for more optimal reproduction of both low and high frequencies, the density of the first diaphragm member 20 is about 1.7 lbs/ft$^3$, and the density of the second diaphragm member 22 is about 3.0 lbs/ft$^3$. These different densities are determined by the well known process of pre-expanding the polystyrene beads prior to molding to achieve the desired densities.

To further enhance the frequency response of the loudspeaker 10, the raised center portion of the rear surface 26 of the first diaphragm member 20 tapers towards the periphery with a gradual curve. Moreover, it has been found desirable to form a number of radially-extending grooves 38 and recesses 40 in the rear surface 26 of the first diaphragm member 20 (FIG. 2) for improved linearity of vibrational movement of the diaphragm during operation.

As best shown in FIGS. 2 and 4, a relatively large and generally wedge-shaped recess 42 also is formed in the rear surface 26 of the first diaphragm member 20. A shallower and narrower rectangular recess 44 further extends on an incline from the wedge-shaped recess 42 into the second diaphragm member 22. The purpose of these recesses 42 and 44 is to provide clearance for a conventional transformer (not shown) that may be mounted within the frame structure 16, so that the diaphragm 12 does not contact the transformer while vibrating. Because these recesses 42 and 44 are off-center, they create an undesirable imbalance in the diaphragm 12. To correct this problem, a number of holes 46 are additionally formed in the rear surface 26 of the first diaphragm member 20 into which metal weights (also not shown) can be inserted for balance.

Turning to FIGS. 5–8, there is illustrated an alternative embodiment of the invention comprising a planar diaphragm loudspeaker 100 embodying a one-piece, dual density planar diaphragm 102 with dual voice coil assemblies 104 and 106 for low frequency and high frequency sound reproduction, respectively, mounted in a supporting frame structure 108. In FIG. 5, the back of the loudspeaker 100 is exposed to show that the rear surface 110 of the one-piece diaphragm 102 is divided into a low frequency section 112 and a high frequency section 114. The low frequency voice coil assembly 104 is coupled to the center of the low frequency section 112 of the diaphragm 102 and the high frequency voice coil assembly 106 is coupled to the center of the high frequency section 114 of the diaphragm. The front surface 115 of the diaphragm 102 is smooth and flat.

In FIGS. 6–8, the details of the rear surface 110 of the planar diaphragm 102 alone are shown, removed from the frame structure 108. The diaphragm 102 has a generally flat and rectangular configuration, and the low frequency and high frequency sections 112 and 114, respectively, are themselves generally rectangular in overall shape.

By viewing FIG. 6 in conjunction with FIG. 7, it can be seen that the low frequency section 112 includes a raised symmetric cross 116 with raised blocks 118 located between the arms of the cross, near the corners of the section. The cross 116 encourages the low frequency section 112 of the diaphragm 102 to move symmetrically and linearly in response to vibration from the low frequency voice coil assembly 104. Laterally extending grooves 120 formed in opposing arms of the cross 116 have been found to improve linearity in the movement of the low frequency section 112 by increasing its flexibility. The four raised blocks 118 help control the excursion of the low frequency section 112 and provide needed rigidity at the corners. A channel 122 in the rear surface 110 of the diaphragm 102 that encircles the cross 116 and raised blocks 118 defines the area of low frequency sound energy emission for the diaphragm.

A flat circular indentation 124 in the center of the cross 116 provides a surface to which the low frequency voice coil assembly 104 can be coupled by epoxy cement or other suitable means. A rigid pad of thermal insulation material (not shown) may be sandwiched between the low frequency voice coil assembly 104 and the diaphragm 102 to protect the diaphragm material from excessive heat which can be generated by the voice coil assembly at higher power levels. A plurality of holes 126 are formed in the low frequency section 112 to receive weights (not shown) for balance and to help stabilize the movement of the diaphragm 102 and encourage it to move linearly. Other holes 128 are provided for clearance relative to screws or other fasteners (not shown) used to mount the low frequency voice coil assembly 104 on the frame structure 108 (FIG. 5).

Looking at FIG. 6 now in conjunction with both FIGS. 7 and 8, the center of the high frequency section 114 also includes a flat, circular land 130, defined by a surrounding channel 131, that provides a surface to which the high frequency voice coil assembly 106 can be coupled by epoxy cement or other suitable means. The land 130 localizes the sound energy to the front surface 115 of the diaphragm 102 and thereby increases the efficiency of the high frequency voice coil assembly 106. Two channels 132 that straddle the circular land 130 increase the stiffness of the high frequency section 114 and improve its frequency response. The channels have a vertical wall 134 and an inclined wall 136 that help improve the linearity of movement by the high frequency section 114 when the voice coil assembly 106 vibrates. The high frequency section 114 is also encircled by a channel 138 in the rear surface 110 of the diaphragm 102 that defines the area of high frequency sound energy emission for the diaphragm. The cross-sectional view in FIG. 7 shows that the overall height of the high frequency section 114 is greater than the overall height of the low frequency section 112, although the heights of the circular indentation 124 and the land 130 are approximately equal.

Referring to FIG. 7, the cross-hatching again indicates that the low frequency section 112 has a lower density (1.7 lbs/ft$^3$) than the density of the high frequency section 114 (3.0 lbs/ft$^3$). However, unlike the diaphragm illustrated in FIGS. 2–4, this dual-density diaphragm 102 is molded of Scott MB500 polystyrene in a one-piece construction by a well known process. To this end, the mold for the diaphragm 102 utilizes a conventional gate to initially isolate the low frequency and high frequency sections from each other within the mold. The polystyrene beads are pre-expanded to achieve the desired densities, as before, and are then injected into the appropriate sections of the mold. The gate is then lifted or opened as the molding process takes place to yield a one-piece diaphragm.

The frame structure 108 shown in FIG. 5 comprises four channel members 108A–108D joined at their ends to form a rectangle that is substantially the same size as the diaphragm 102. The diaphragm 102 is adhered to the face of the frame structure 108 by suitable means such as double-sided tape. A cross-piece 108E extends laterally between the two longitudinal channel members 108A and 108C of the frame structure 108 and is in contact with the rear surface 110 of the diaphragm 102 between the high frequency and low frequency sections 112 and 114, respectively. The cross-piece 108E acts like a mechanical cross-over network preventing frequencies reproduced by one frequency section from being reproduced by the other section. A pair of frame mounting members 108F and 108G extend longitudinally between the two lateral channel members 108B and 108D. The mounting members 108F and 108G provide a convenient support to which the two voice coil assemblies 104 and 106 can be attached and strengthen the frame 108.

The loudspeaker 100 is sized to mount in a suitable opening between normally spaced studs or joists in a ceiling or a wall of a residential structure. Because the front surface 115 of the diaphragm 102 is substantially smooth and flat and is adhered to the face of the frame 108, it can be installed flush with the surrounding wall surface and, by filling and taping the seams, the loudspeaker 100 can be made a seamless part of the wall. The front surface 115 can be painted over with a variety of materials or covered with wallpaper, whichever provides the desired appearance. However, if the diaphragm is constructed of styrene plastic, no oil base paints or other solvents should be applied, as they can attack the styrene.

The present invention has been described above in terms of two presently preferred embodiments so that an understanding of the invention can be conveyed. There are, however, many configurations for loudspeakers and diaphragms not specifically described herein for which the present invention is applicable. The present invention should therefore not be seen as limited to the particular embodiments described above. All modifications, variations, or equivalent arrangements that are within the scope of the attached claims should therefore be considered to be within the scope of the invention.

We claim:

1. A loudspeaker comprising:

a substantially stiff, planar diaphragm having first and second generally rectangularly-shaped frequency sections adjoined along one side thereof to form a smooth and flat front surface for the planar diaphragm, the first frequency section configured for reproduction of low frequency sound and the second frequency section configured for reproduction of high frequency sound, and the rear surface of the first rectangularly-shaped frequency section including four generally rectangularly-shaped raised blocks located at the corners of the first frequency section, the sides of each block having a length that extends approximately one-third of the length of the first frequency section's adjacent side such that the raised blocks define radiating arms in the areas of the rear surface intermediate the raised blocks, the radiating arms forming a cross pattern centered within the first frequency section; and a voice coil coupled to each of the first and second frequency sections such that each voice coil receives an electrical signal and vibrates in response, thereby causing sound to emanate from the front surface of the planar diaphragm.

2. A loudspeaker as defined in claim 1, wherein the cross pattern includes a raised dome concentrically located on the cross pattern, wherein a corner of each raised block protrudes into the dome.

3. A loudspeaker as defined in claim 2, wherein the corner of each raised block that protrudes into the dome has an acute angle that generally points toward the center of the first frequency section and protrudes a distance that is approximately one-third of the dome's breadth.

4. A loudspeaker as defined in claim 1, further comprising a flat circular indentation located in the center of the cross pattern for providing a surface for coupling the respective voice coil to the first frequency section.

5. A loudspeaker as defined in claim 1, wherein the planar diaphragm is formed as a unitary, one-piece structure from a pre-expanded cellular plastic material such that the density of the first frequency section is different from the density of the second frequency section.

6. A loudspeaker as defined in claim 1, wherein the density of the second frequency section is in the range of about 2.5 to 4.0 lbs/ft$^3$ and the density of the first frequency section is in the range of about 1.5 to 2.5 lbs/ft$^3$.

7. A loudspeaker as defined in claim 1, wherein at least two of the radiating arms have grooves formed therein.

8. A loudspeaker as defined in claim 1, wherein the first frequency section is encircled by a channel.

9. A loudspeaker as defined in claim 1, wherein the second frequency section includes a raised circular portion defined by a surrounding channel and raised block portions on opposite sides of the raised circular portion.

10. A loudspeaker as defined in claim 9, wherein the second frequency section is encircled by a channel.

* * * * *